US006650246B2

(12) United States Patent
Field et al.

(10) Patent No.: US 6,650,246 B2
(45) Date of Patent: Nov. 18, 2003

(54) METHOD AND APPARATUS FOR IMPROVING THE SAFETY OF INFLATABLE ATTRACTIONS AND OTHER INFLATABLE DEVICES

(75) Inventors: Brian J. Field, Inver Grove Heights, MN (US); Robert J. Field, Lakeville, MN (US)

(73) Assignee: Safety Air Systems, LLC, Inver Grove Heights, MN (US)

( * ) Notice: Subject to any disclaimer, the term of this patent is extended or adjusted under 35 U.S.C. 154(b) by 0 days.

(21) Appl. No.: 10/241,754

(22) Filed: Sep. 11, 2002

(65) Prior Publication Data

US 2003/0197621 A1 Oct. 23, 2003

(51) Int. Cl.[7] ..... G08B 21/00
(52) U.S. Cl. ..... 340/657; 340/663; 472/134
(58) Field of Search ..... 340/657, 660, 340/661, 663; 446/220–226, 483; 273/129 AP; 472/100, 134

(56) References Cited

U.S. PATENT DOCUMENTS 4,707,953 A 11/1987 Anderson et al. ..... 52/63
4,818,970 A 4/1989 Natale et al. ..... 340/539
4,870,393 A 9/1989 Snuttjer et al. ..... 340/611
5,471,797 A * 12/1995 Murphy ..... 52/2.17
5,603,185 A * 2/1997 Murphy ..... 52/2.17
5,678,357 A * 10/1997 Rubio et al. ..... 52/2.17
5,685,122 A 11/1997 Brisbane et al. ..... 52/745.07
5,906,373 A * 5/1999 Sanders ..... 273/349

* cited by examiner

*Primary Examiner*—Toan Pham
(74) *Attorney, Agent, or Firm*—Schwegman, Lundberg, Woessner & Kluth, P.A.

(57) ABSTRACT

A system and method of using a blower device to maintain an inflatable carnival attraction at a level of inflation safe for using the inflatable attraction, wherein the blower device operates on electrical energy received from an external source, monitoring the electrical energy, and triggering an alarm if the electrical energy is insufficient for the blower device to maintain the level of inflation safe for using the inflatable attraction, wherein the alarm is of sufficient loudness to be heard by personnel operating the attraction at a location distant from the blower device.

47 Claims, 4 Drawing Sheets

METHOD AND APPARATUS FOR IMPROVING THE SAFETY OF INFLATABLE ATTRACTIONS AND OTHER INFLATABLE DEVICES

FIELD OF THE INVENTION

The present invention relates generally to inflatable attractions and advertising displays, and more particularly to safety methods and systems for continuous air-fed inflatable devices.

BACKGROUND

Inflatable carnival attractions have grown increasingly popular in recent years for several reasons including their portability, ease of operation and fanciful shapes, colors and sizes that appeal to young children. These attractions are typically designed to inflate and provide crawl spaces, slides or trampoline jumping surfaces. Such attractions are often found at picnics, fairs, birthday parties, carnivals and other gatherings where children are present.

Referring to FIG. 1, there is illustrated one example embodiment of an inflatable carnival attraction 100 inflated using a blower device 110. As illustrated, the example carnival attraction includes a stairway 112, a first portion that forms a slide 115 for children and a second portion that forms a trampoline-like jumping surface 120 for children to jump up and down on. Such attractions are typically formed of vinyl or nylon material. Blower device 110 is adapted to inflate the carnival attraction and is coupled to an inlet conduit 125 of the attraction. Typically a strap 127 is used to couple the port of conduit 125 to the blower outlet. Pressurized air from the blower device continuously passes through conduit 125 and into the attraction, keeping it inflated at a level safe for use.

Unfortunately, like all such attractions, injuries will occur if they are used or operated improperly. Moreover, such attractions are largely unregulated in many states, increasing the possibility that untrained personnel are in a position to operate them.

In addition, the inflatable carnival attraction industry is highly fragmented due to rapid growth and low barriers to entry. There are many manufacturers of the devices and even more owner-operators. As such, the industry lacks the coherency and safety standards organizations and discipline that is found in more mature and concentrated industries. Accordingly, improvements in safety features in this industry have, from one point of view, been modest.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 2:
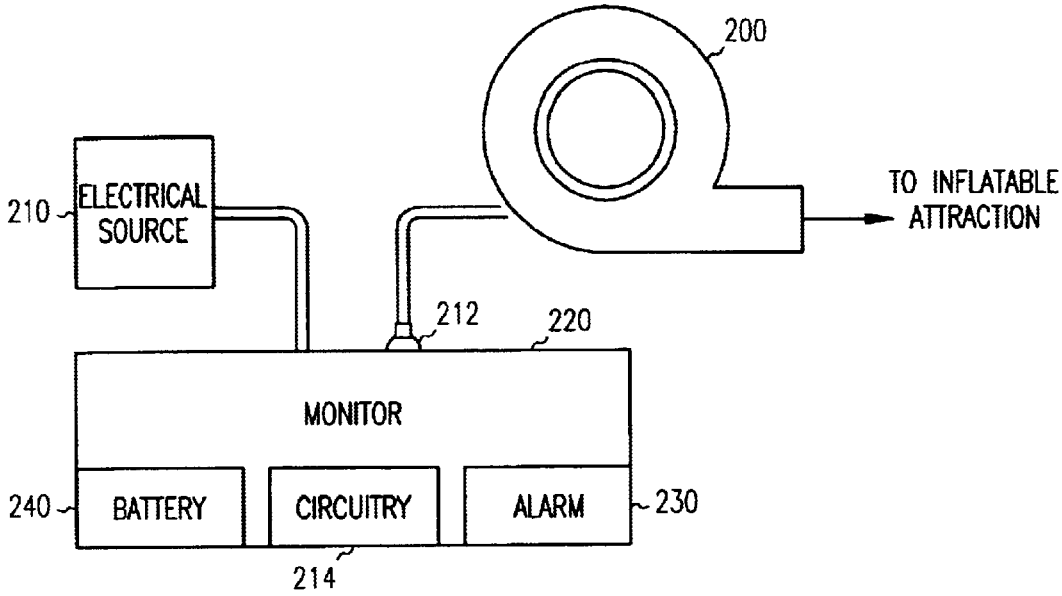
FIG. 2 illustrates a blower having an alarm monitor according to one embodiment.

FIG. 2 schematically illustrates a blower 200 attached to an alarm monitor 220 according to one embodiment of the present invention. According to one example embodiment of the invention there is provided a method wherein blower device 200 is used to maintain an inflatable carnival attraction at a level of inflation safe for using the inflatable attraction, and wherein the blower device 200 operates on electrical energy received from an external source 210. The electrical energy is monitored by monitor 220, and an audible alarm 230 is sounded if the electrical energy is insufficient for the blower device 200 to maintain the level of inflation safe for using the inflatable attraction, and wherein the alarm is of sufficient loudness to be heard by personnel operating the attraction at a location distant from the blower device.

A typical blower device used for inflatables has a power consumption of 110V or 220 V (50 or 60 Hz) and 20 Amps or less. Electrical source 210 can be a household or commercial power supply or can be a stand-alone generator. In this example, monitor 220 is plugged into electrical source 210 and blower 200 is plugged into monitor 220 at a 20 Amp GFI outlet 212. Blowers can have oval, round, or other shaped outlets.

According to still another example embodiment, the blower device 200 has an output capacity in the range of 100–1000 cfm (11.3–28.3 $m^3$/min) at 5–10 inches water static pressure. Some blowers operate at 3 inches of static water pressure or less and 1500–3000 cfm or more. Various blowers in accordance with the system can have output air flow of 100–5000 cfm. The type of inflatable will determine the operating characteristics of the blower needed. For instance, an advertising inflatable device typically uses a high output, low pressure blower, while carnival attractions use low output, high pressure blowers to account for people jumping on them. The present system is also applicable to internal blowers which are blowers which are incorporated inside the inflatable. The internal blowers have their air intake sealed to the side of the inflatable to draw air into the blower. The blowers are continuously on to keep the pressure and air volume of the inflatable at safe operating levels.

Monitor 220 can be a current detector or a voltage detector, for example. In one example, monitor 220 includes circuitry 214 to activate alarm 230 when the load from electrical source 210 either fails, is switched off, or is unplugged. Moreover, if the motor of blower 200 fails the resulting current overload will cause GFI outlet 212 to open, also causing the alarm to be activated. Some embodiments include an internal circuit breaker within monitor 220 to activate the alarm if an amp overload occurs.

For example, circuitry 214 can include a normally closed relay coupled between a power storage device 240 and alarm 230. When current passes through circuitry 214, a normally open current switch closes and powers the relay, thus opening the relay. If the current either stops or decreases sufficiently to not be able to power the blower, either because of power supply failure or the opening of the GFI outlet switch, the relay loses power and closes, activating alarm 230.

In one example, alarm 230 is an approximately 110 decibel siren. According to various alternate embodiments, the loudness of the alarm is in the range of 70–140 decibels. The loudness is sufficient to alert personnel who are located in the range of 25–75 feet or more from the blower device and/or out of sight of the blower and/or out of ear shot of the blower and above the din of the crowd.

In other examples, blower 200 is not plugged directly into monitor 220 but instead the monitor includes a piggy-back plug switch with the monitor plugged into the power source and the blower plugged into the piggy-back plug switch.

According to still another example embodiment, the method includes connecting a circuit, such as circuit 214, to a source of electrical power, monitoring the electrical energy originating at the source, and providing power to the blower device from the circuit, wherein if the electrical energy is insufficient for the blower device to maintain the level of inflation safe for using the inflatable attraction, personnel are alerted while operating the attraction at a location distant from the blower device.

According to another example embodiment, stored energy member 240, such as a capacitor or a battery, is used to power one or more components used to provide the alert to the personnel. The stored energy member 240 has sufficient energy to sound the alarm in the decibel range discussed above. In some examples, the system can include a sensor to detect whether the power in the battery is getting low and either set off alarm 250 or a separate alarm to warn of possible battery failure.

Figure 3:
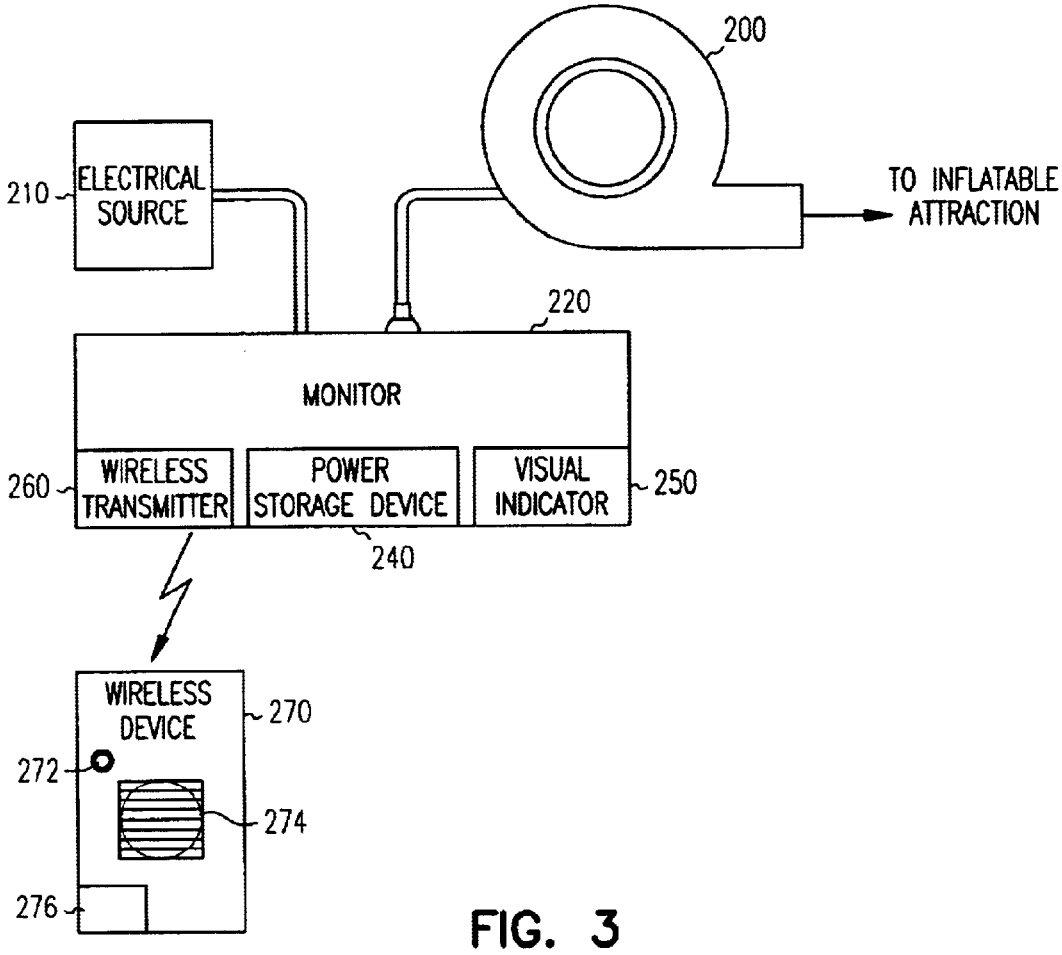
FIG. 3 illustrates a blower having an alarm monitor according to one embodiment.

According to still further example embodiments shown in FIG. 3, the alert can be supplied by a visual indicator 250, or the alert is supplied by a transmitter 260 to a wireless device 270 carried by at least one operating personnel and/or the wireless device 270 includes a visual alarm 272, an audible alarm device 274, or a vibrating alarm device 276. Some example systems include any of the alarm types discussed above.

Figure 4:
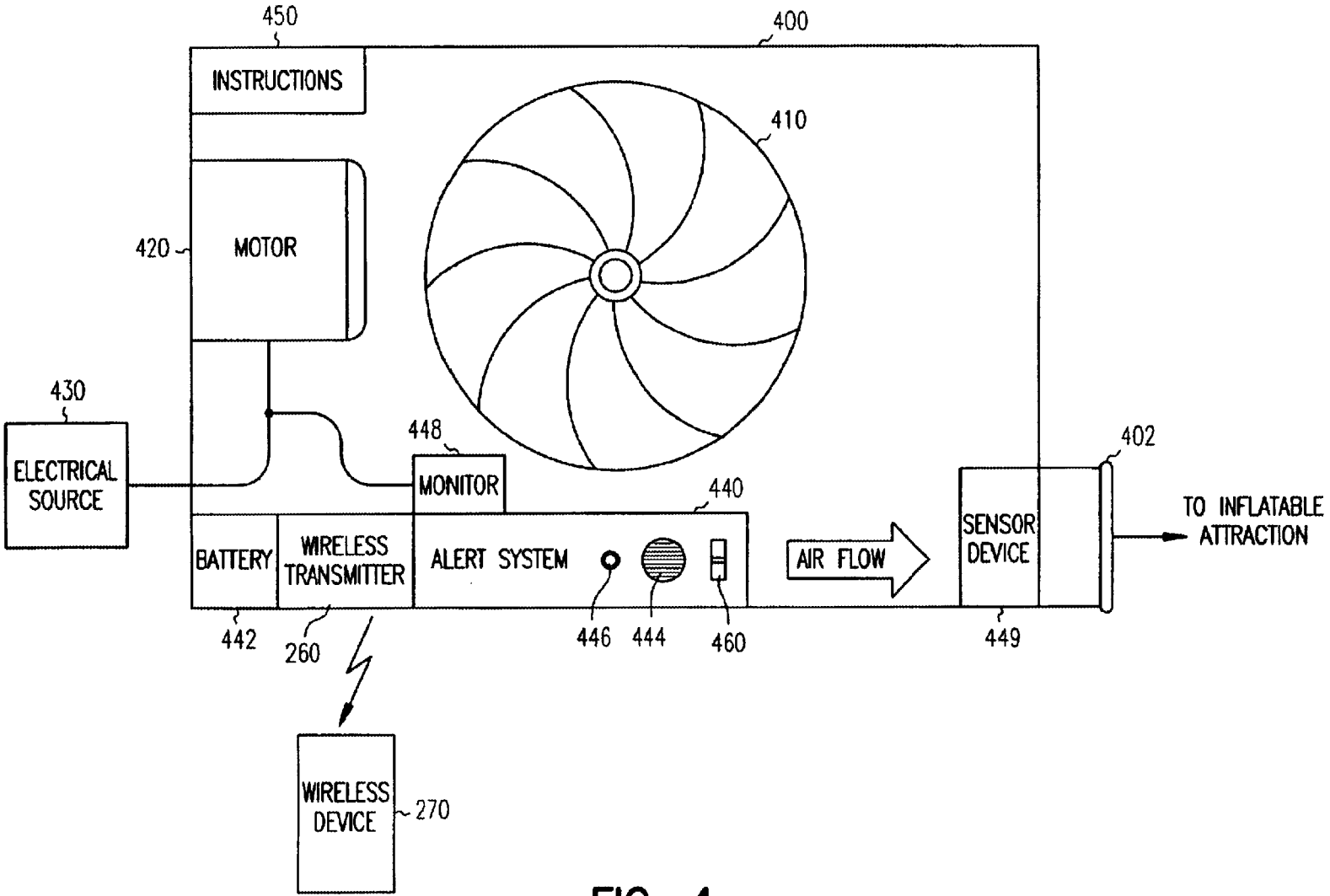
FIG. 4 illustrates a blower having an alarm system according to one embodiment.

According to still another example embodiment of an apparatus according the invention, as illustrated schematically in FIG. 4, there is provided a blower device 400 comprising a fan 410 driven by a motor 420 connected to a source of power 430 wherein the blower device 400 is adapted to inflate an inflatable carnival attraction and includes an alert system 440 that provides an alert to an operator of the carnival attraction if the blower device fails to operate in a manner sufficient to maintain the attraction in a properly inflated condition.

According to a still further example embodiment also illustrated in FIG. 4, the alert system 440 includes a stored energy source 442, such as a battery or capacitor, to power one or more components of the alert system at least part of the time.

According to yet another example embodiment, the alert is an audible alarm 444 and optionally the audible alarm operates at a loudness sufficient for an operator of the carnival attraction to hear the alarm at a position a substantial distance from the blower device in the presence of noise made by children using the attraction. One example is a 110 decibel siren. Other examples can range from 70–140 decibels.

According to still another example embodiment, the alert system includes a visual indicator 446.

In still another example embodiment illustrated in FIG. 4, the alert system can optionally include a wireless device 270 (as discussed above) carried by an operator and the wireless device provides the alert to the operator, and optionally the wireless device carried by the operator produces a tactile alert, or audio or visual alerts.

Alert system 440 includes a monitor device 448 coupled between the electrical source 430 and the motor 420 and that monitors the power supplied to the motor 420 and initiates an alert when the power falls to an unacceptable level. The monitor can detect current or voltage, as discussed above for monitor 220. Moreover, monitor 448 can be adapted to detect an over-current situation and trigger the alarm if the blower becomes jammed, for example. In some embodiments, for example, a circuit breaker is incorporated into monitor 448 and wired to trigger the alarm if an amp overload occurs.

According to still another example embodiment shown in FIG. 4, the alert system includes a sensor device 449 that monitors the air flow or air pressure output by the fan 410 and initiates an alert when the air flow falls to an unacceptable level.

Alert system 440 can be a separate system connected to the blower device 400 or the alert system can be integrated into the blower.

For example, according to still another example embodiment of the apparatus of the invention shown in FIG. 4, blower device 400 can include a fan driven by a motor connected to a source of power wherein the blower device is adapted to inflate an inflatable carnival attraction and includes an integrated alert system 440 that provides an alert to an operator of the carnival attraction if the blower device fails to operate in a manner sufficient to maintain the attraction in a properly inflated condition. As used herein, the term "integrated" includes but is not limited to housing the alert system in the same housing as the fan or motor or fastening the alert system in a substantially non-removable manner.

Thus, according to various alternate embodiments of the apparatus of FIG. 4, the blower device has an output capacity as discussed above and/or the alert system includes a sensor device that monitors the power supplied to the motor and initiates an alert when the power falls to an unacceptable level and/or the alert system includes a sensor device that monitors the air flow output by the fan and initiates an alert when the air flow falls to an unacceptable level.

According to still other example embodiments of the apparatus and methods of the invention herein described above or below, an inflatable advertising attraction is substituted for the inflatable carnival attraction.

Figure 1:
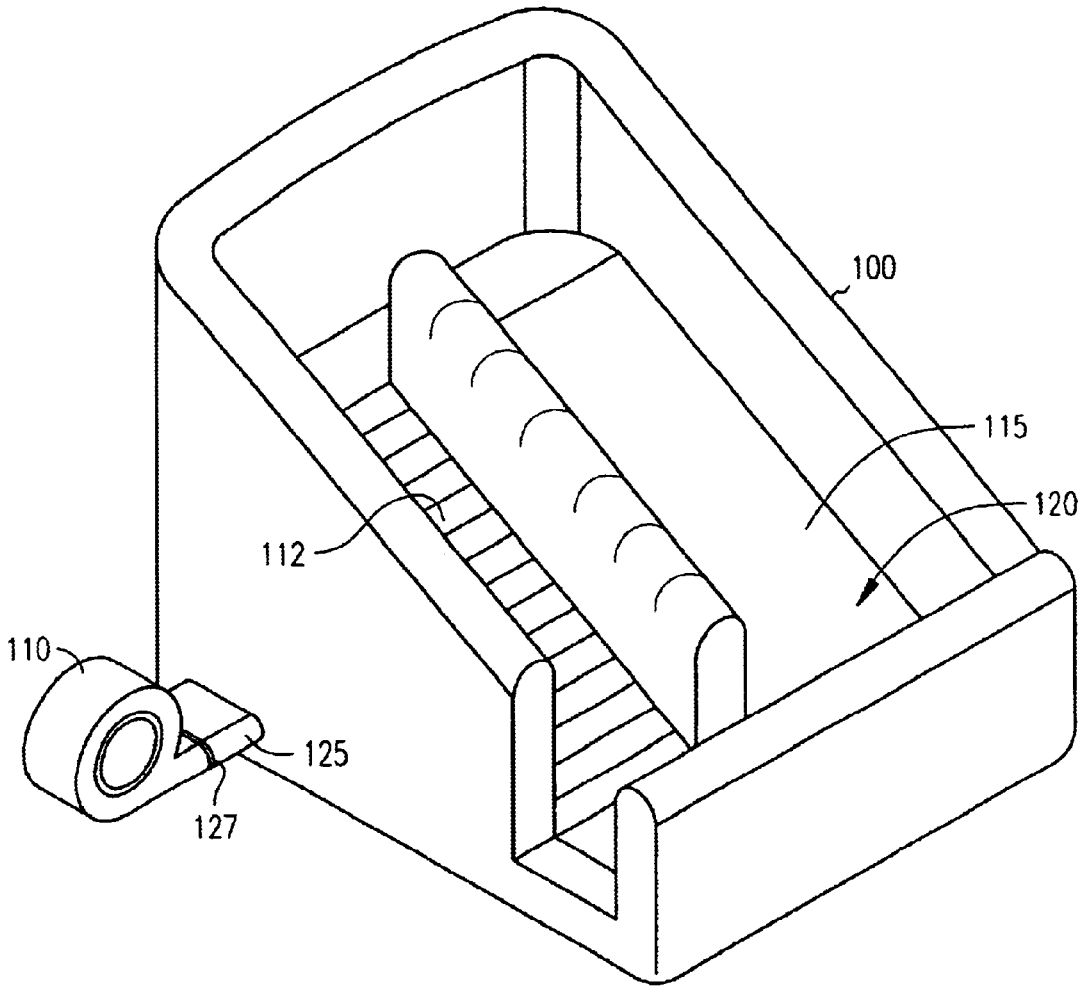
FIG. 1 illustrates an inflatable attraction.

According to still another example embodiment of the above described methods and apparatus, the blower device is adapted to connect to an air supply conduit connected to the inflatable carnival attraction. For example, some blowers include a lip 402 around the outer edge of the output port. Referring again to FIG. 1, this lip helps attach the conduit 125 to the blower outlet when the conduit 125 is tied around the lip of the edge. Other blowers include velcro coupling or other clamping mechanism to clamp the conduit 125 around the blower output port.

Referring again to FIG. 4, according to still another example embodiment there is provided an alert system adapted to operate with a blower device used to inflate an inflatable carnival or advertising attraction, wherein the alert system provides an alert if the blower device is unable to operate in a manner sufficient to maintain the attraction in a properly inflated condition, and further wherein operator instructions 450 explaining the use of the alert system in connection with the blower device are affixed to the alert system or the blower.

According to still other example embodiments of the above-described methods and apparatus, as for example illustrated in FIG. 4, the alert system includes an alert disabling switch 460 usable by an operator to turn-off an alert signal produced by the alert system. Further, optionally the alert disabling switch is operated with a key.

Figure 5:
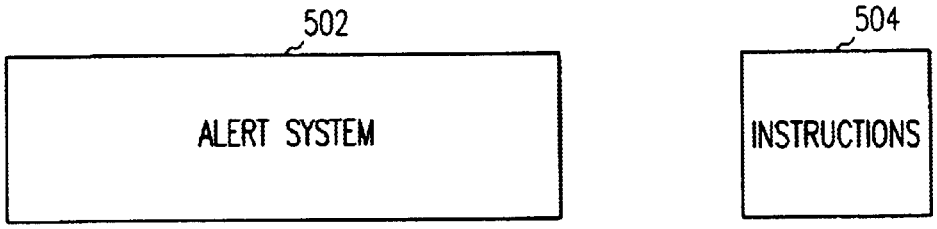
FIG. 5 illustrates an alert system kit for a blower according to one embodiment.

According to still another example embodiment of the method and apparatus illustrated in FIG. 5, there is provided a kit that includes an alert system 502 with instructions 504 for use with a blower device and an inflatable carnival attraction, wherein the instructions inform an operator of the attraction how to use the alert system to warn the operator if the blower device is incapable of maintaining the attraction at a safe level of inflation.

Figure 6:
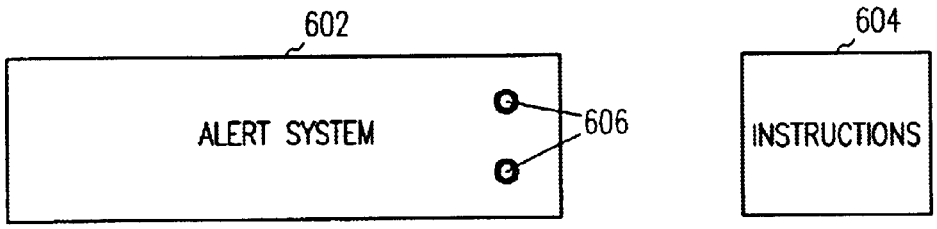
FIG. 6 illustrates an alert system kit for a blower according to one embodiment.

According to still another example embodiment of the method and apparatus illustrated in FIG. 6, there is provided a kit that includes an alert system 602 with instructions 604 for installing or integrating the alert system into a blower device adapted to inflate an inflatable carnival attraction, wherein the alert system includes interface connections 606 that are adapted to be connected to the blower device.

In various embodiments, the details given above can be optionally included in any of the alert systems 220, 440, 502, or 602 described herein. For example, any of the systems described above can include one or more of the following options. The loudness of alarm can be high enough to be heard over screams of kids, blower, distance to operator location. The alarm system can be a stand-alone system or can be integrated with the blower. One option includes a stand-alone unit that can be used to monitor external power to the blower. One option provides a alarm system kit that can be added to the blower. One option has air movement or air pressure monitors. One option monitors electrical power at the motor inputs. An alarm disabling system can be provided. The alarm system can be battery operated.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A method comprising:

using a blower device to maintain an inflatable carnival attraction at a level of inflation safe for using the inflatable attraction, wherein the blower device operates on electrical energy received from an external source;

monitoring the electrical energy; and sounding an audible alarm if the electrical energy is insufficient for the blower device to maintain the level of inflation safe for using the inflatable attraction, wherein the alarm is of sufficient loudness to be heard by personnel operating the attraction at a location distant from the blower device.

2. A method according to claim 1 wherein the loudness is in the range of 70–140 decibels.

3. A method according to claim 1 wherein the personnel are located in the range of 25–75 feet from the blower device.

4. A method comprising:

using a blower device to maintain an inflatable carnival attraction at a level of inflation safe for using the inflatable attraction, wherein the blower device operates on electrical energy received from an external source;

monitoring the electrical energy; and alerting personnel operating the attraction if the electrical energy is insufficient for the blower device to maintain the level of inflation safe for using the inflatable attraction, wherein the personnel are alerted while operating the attraction at a location distant from the blower device.

5. A method according to claim 4 further including using a battery to power one or more components used to provide the alert to the personnel.

6. A method according to claim 4 further wherein the alert is supplied by an audible alarm.

7. A method according to claim 6 wherein the loudness is in the range of 70–140 decibels.

8. A method according to claim 4 wherein at least one personnel are located in the range of 25–75 feet from the blower device.

9. A method according to claim 4 wherein at least one personnel is located out of sight of the blower device.

10. A method according to claim 9 further wherein the at least one personnel is located out of earshot of the sound made by the blower.

11. A method according to claim 4 further wherein the alert is supplied by a visual indicator.

12. A method according to claim 4 further wherein the alert is supplied by a wireless device carried by at least one operating personnel.

13. A method according to claim 12 further wherein the wireless device includes an audible alarm device or a vibrating alarm device.

14. A method according to claim 4 further including connecting a circuit to a source of electrical power, monitoring the electrical energy originating at the source, and providing power to the blower device from the circuit.

15. A blower device comprising a fan driven by a motor connected to a source of power wherein the blower device is adapted to inflate an inflatable carnival attraction and includes an alert system that provides an alert to an operator of the carnival attraction if the blower device fails to operate in a manner sufficient to maintain the attraction in a properly inflated condition.

16. A blower device according to claim 15 further wherein the alert system includes a battery to power one or more components of the alert system at least part of the time.

17. A blower device according to claim 15 wherein the blower device has an output capacity in the range of 100–5000 cfm.

18. A blower device according to claim 15 further wherein the alert is an audible alarm.

19. A blower device according to claim 18 wherein the audible alarm operates at a loudness sufficient for an operator of the carnival attraction to hear the alarm at a position a substantial distance from the blower device in the presence of noise made by children using the attraction.

20. A blower device according to claim 15 further wherein the alert system includes a visual indicator.

21. A blower device according to claim 15 further wherein the alert system includes a wireless device carried by an operator and the wireless device provides the alert to the operator.

22. A blower device according to claim 21 further wherein the wireless device carried by the operator produces a tactile alert.

23. A blower device according to claim 15 wherein the alert system includes a sensor device that monitors the power supplied to the motor and initiates an alert when the power falls to an unacceptable level.

24. A blower device according to claim 15 wherein the alert system includes a sensor device that monitors the air flow or air pressure output by the fan and initiates an alert when the air flow falls to an unacceptable level.

25. A blower device according to claim 15 further wherein the alert system includes an alert disabling switch usable by an operator to turn-off an alert signal produced by the alert system.

26. A blower device according to claim 25 further wherein the alert disabling switch is operated with a key.

27. A blower device comprising a fan driven by a motor connected to a source of power wherein the blower device is adapted to inflate an inflatable carnival attraction and includes an integrated alert system that provides an alert to an operator of the carnival attraction if the blower device fails to operate in a manner sufficient to maintain the attraction in a properly inflated condition.

28. A blower device according to claim 27 wherein the blower device has an output capacity in the range of 100–5000 cfm.

29. A blower device according to claim 27 wherein the alert system includes a sensor device that monitors the power supplied to the motor and initiates an alert when the power falls to an unacceptable level.

30. A blower device according to claim 27 wherein the alert system includes a sensor device that monitors the air flow output by the fan and initiates an alert when the air flow falls to an unacceptable level.

31. A blower device comprising a fan driven by a motor connected to a source of power wherein the blower device is adapted to inflate an inflatable advertising attraction and includes an integrated alert system that provides an alert if the blower device fails to operate in a manner sufficient to maintain the attraction in a properly inflated condition.

32. A blower device according to claim 31 wherein the blower device has an output capacity in the range of 100–5000 cfm.

33. A blower device according to claim 31 wherein the alert system includes a sensor device that monitors the power supplied to the motor and initiates an alert when the power falls to an unacceptable level.

34. A blower device according to claim 31 wherein the alert system includes a sensor device that monitors the air flow output by the fan and initiates an alert when the air flow falls to an unacceptable level.

35. A blower device according to claim 31 further wherein the alert is an audible alarm.

36. A blower device according to claim 35 wherein the audible alarm operates at a loudness sufficient for an operator of the carnival attraction to hear the alarm at a position a substantial distance from the blower device in the presence of noise made by children using the attraction.

37. A blower device according to claim 31 further wherein the alert system includes a visual indicator.

38. A blower device according to claim 31 further wherein the alert system includes a wireless device carried by an operator and the wireless device provides the alert to the operator.

39. A blower device according to claim 38 further wherein the wireless device carried by the operator produces a tactile alert.

40. A blower device according to claim 31 wherein the alert system includes a sensor device that monitors the power supplied to the motor and initiates an alert when the power falls to an unacceptable level.

41. A blower device according to claim 31 wherein the alert system includes a sensor device that monitors the air flow output by the fan and initiates an alert when the air flow falls to an unacceptable level.

42. A blower device comprising a fan driven by a motor connected to a source of power wherein the blower device is adapted to inflate an inflatable advertising attraction and includes an integrated alert system that provides an alert if the blower device fails to operate in a manner sufficient to maintain the attraction in a properly inflated condition.

43. An alert system adapted to operate with a blower device used to inflate an inflatable carnival attraction, wherein the alert system provides an alert if the blower device is unable to operate in a manner sufficient to maintain the attraction in a properly inflated condition.

44. An alert system according to claim 43 further wherein the alert system includes an alert disabling switch usable by an operator to turn-off an alert signal produced by the alert system.

45. An alert system according to claim 44 further wherein the alert disabling switch is operated with a key.

46. An alert system according to claim 43 further including a circuit adapted to be connected to a source of electrical power and wherein a monitoring circuit monitors the electrical energy originating at the source, and wherein the circuit is further adapted to provide power to the blower device.

47. An alert system adapted to operate with a blower device used to inflate an inflatable carnival or advertising attraction, wherein the alert system provides an alert if the blower device is unable to operate in a manner sufficient to maintain the attraction in a properly inflated condition, and further wherein operator instructions explaining the use of the alert system in connection with the blower device are affixed to the alert system.

* * * * *